US005961426A

United States Patent [19]

Spector

[11] Patent Number: 5,961,426

[45] Date of Patent: Oct. 5, 1999

[54] PNEUMATIC BOP BAG

[76] Inventor: Donald Spector, 380 Mountain Rd., Union City, N.J. 07080

[21] Appl. No.: 08/855,490

[22] Filed: May 13, 1997

[51] Int. Cl.[6] ..... A63H 3/06

[52] U.S. Cl. ..... 482/83; 482/85; 482/86; 446/220; 446/223; 446/396

[58] Field of Search ..... 482/83, 85, 86, 482/87, 90; 446/226, 396, 220, 221, 223

[56] References Cited

U.S. PATENT DOCUMENTS

| | | | |
|---|---|---|---|
| 2,939,707 | 6/1960 | Lemelson | 446/220 |
| 4,527,796 | 7/1985 | Critelli | 482/86 |
| 5,522,757 | 6/1996 | Ostrowski | 446/220 |

OTHER PUBLICATIONS

Punch Me's, Sear's Christmas Catalog, 1974.

*Primary Examiner*—Richard J. Apley
*Assistant Examiner*—Glenn Richman
*Attorney, Agent, or Firm*—Michael Ebert

[57] ABSTRACT

A pneumatic bop bag which rests on the ground and simulates a humanoid figure having a head, the bag being normally erect. When a player punches the head, the bag is caused to swing to a degree that depend on the force of the punch, the bag then swinging back to resume its erect position. The bag is formed by a collapsible fabric casing having an upper head zone, an intermediate torso zone and a base zone that rests on the ground. The head and torso zones are occupied by an inflated balloon which conforms to the contours of these zones to cause the bag to assume a three-dimensional shape. Confined within the base zone is a weighted convex dish whose center pole which engages the ground is normally aligned with a vertical axis. When the bag is punched and swings away from this vertical axis, the gravitational force imposed on the dish causes the bag to return to its normal position whereby it is again erect.

7 Claims, 1 Drawing Sheet

PNEUMATIC BOP BAG

BACKGROUND OF THE INVENTION

1. Field of Invention

This invention relates generally to bop bags which rest on the ground and are normally erect whereby when the bag is punched by a player it then swings away from a vertical axis to a degree that depends on the force of the punch, and then swings back to resume its erect position, and more particularly to a bop bag of this type formed by a fabric casing occupied by an inflated balloon.

2. Status of Prior Art

A punching bag is a stuffed or inflated leather bag that is suspended above ground so that it can be punched by the fists for exercise or training. Thus professional boxers make use of punching bags when training for a fight.

A bop bag which rests on the ground and is punched by the fists serves a function in which exercise may play a secondary role. A conventional bop bag consists of an inflatable plastic pouch formed of polyvinyl or polyethylene material of high strength, shaped to have the appearance of a humanoid figure whose head is at the upper end of the bag.

Confined within the base of the plastic bag is a convex dish that is weighted by sand or other relatively heavy material which is uniformly distributed. When this dish rests on a horizontal ground surface, its center axis which extends through the pole of the convex surface is then aligned with a vertical axis at right angles to the ground surface.

The center of gravity in a convex dish is at its center pole, for this is the fixed point in the dish through which the resultant gravitational attraction acts. When therefore one punches the bag to cause the convex dish confined in its base to swing away from the vertical axis to a degree that depends on the force of the punch, the gravitational force acting on the dish will cause it to swing back and return the bag to its erect position.

In a suspended punching bag, a punch causes the bag to swing upwardly, and gravity then causes the bag to swing down. But in a bop bag, it is the force of gravity acting on the weighted dish that restores the bag to its erect position.

The popularity of a bop bag cannot to any great extent be attributed to its function as an exerciser, for it has a more significant symbolic function. The bag, being in a humanoid form, serves to symbolize in the mind of the player an individual the player has a strong urge to beat up, but cannot do so directly. In beating up the individual symbolized by the bop bag, the player is then relieved of psychological tensions and stresses.

Thus a player who is a student and believes he is being persecuted by one of his teachers, would be ill advised to physically attack this teacher or any other individual in authority. Similarly, a player who is an employee would be ill advised to attack his employer, however offensive he may find his employer's conduct toward him.

Because of the player's inability to retaliate against an individual whom he finds hateful, and his need to bottle up his feelings, the player is then likely to experience psychological stresses and even depression, and this state of mind may be injurious to the player's well being.

Punching a bop bag which symbolically represents an individual responsible for his psychological state, makes it possible for the player to effectively beat up this individual and in the process of doing so relieve the player of his psychological tension. Hence a bop bag has a usefulness that goes beyond its value as an exerciser.

Conventional inflatable bop bags are formed of synthetic plastic material which must be hermetically sealed, yet be capable of withstanding strong punches. If in order to provide a light weight bop bag use is made of a relatively thin plastic material, this bag, may be ruptured and deflated by strong punches and cease to be effective.

But if a thicker plastic skin is used to make the bop bag, the bag will then be relatively top heavy, and when a strong punch is delivered to the bag it may then swing to a degree where instead of swinging back, the top heavy bag will fall to the ground and not recover its erect posture.

Also with an inflated bop bag having a plastic skin which is blown up by its user, the internal pressure in the bag is relatively low, hence the bag lacks good bounce characteristics. The higher the internal bag pressure, the greater is its reaction to a punch, and the lower the pressure, the more the bag absorbs this punch.

Inasmuch as a bop bag in accordance with the invention makes use of a fabric bag which is occupied by an inflated balloon, of prior art interest is the U.S. Pat. No. 4,384,382 to Spector which discloses a pneumatic playball that has the configuration and appearance of a standard pneumatic athletic ball, such as a regulation basketball.

The Spector ball is constituted by an inner inflatable balloon confined within a fabric outer casing. The outer casing is formed by contoured segments of high strength, non-stretchable fabric material stitched together to create, when the casing is fully expanded, a play ball of the desired shape and size, such as a football or soccer ball. The balloon is a conventional thin-skin rubber balloon whose stem initially projects through a slit in the fabric casing. After inlating the balloon with air so that it conforms to the casing, the stem is then tied into a knot to seal the balloon, and the tied stem is pushed into the casing under the slit. An unconfined rubber balloon has little strength and is easily burst. But when the same balloon is inflated within the confines of a non-stretchable fabric casing, even though the balloon, per se, is inherently weak, the casing does not permit any region of the balloon to further expand beyond its existing degree of expansion; hence the balloon will not burst even if the ball is given a hard kick.

The bounce characteristics of a pneumatic ball is a function of its internal air pressure. The reason the Spector ball has high bounce characteristics is that its internal air pressure is much higher than in a conventional beach ball made of a non-stretchable plastic film. A conventional beach ball offers little resistance to expansion until fully inflated, at which point, since the material is non-stretchable, it cannot be further inflated. But with a stretchable rubber balloon, it takes much more air pressure to stretch the from its initial deflated state to its stretched and fully inflated state. As a consequence, the internal air pressure of the balloon in the Spector ball is much higher than in a conventional beach ball and the Spector balloon is much bouncier.

SUMMARY OF INVENTION

In view of the foregoing, the main object of this invention is to provide a pneumatic bop bag formed of a fabric casing having an inflated balloon therein whereby the bag is relatively light yet has high strength, making it capable of withstanding strong punches.

More particularly, an object of this invention is to provide a bop bag of the above type which resembles a humanoid figure whose features are printed on the fabric bag whereby the bag serves to symbolize in the mind of a player a hostile individual.

A significant feature of a bop bag in accordance with the invention which includes a weighted dish confined within the base of the bag is that the major portion of the bag which is above the weighted dish is occupied by an inflated balloon and is therefore relatively light. Hence when the bag is subjected to a strong punch causing the bag to swing to a considerable degree away from the vertical axis, the bag will nevertheless then return to its normally erect position, and not fall to a ground.

Also an object of this invention is to provide a bop bag of the above type which can be manufactured at low cost, and when the bag is not filled by an inflated balloon, can then be collapsed to fit into a relatively small package.

Briefly stated, these objects are attained by a pneumatic bop bag which rests on the ground and simulates a humanoid figure having a head, the bag being normally erect. When a player punches the head, the bag is caused to swing to a degree that depend on the force of the punch, the bag then swinging back to resume its erect position.

The bag is formed by a collapsible fabric casing having an upper head zone, an intermediate torso zone and a base zone that rests on the ground. The head and torso zones are occupied by an inflated balloon which conforms to the contours of these zones to cause the bag to assume a three-dimensional shape. Confined within the base zone is a weighted convex dish whose center pole which engages the ground is normally aligned with a vertical axis. When the bag is punched and swings away from this vertical axis, the gravitational force imposed on the dish causes the bag to return to its normal position whereby it is again erect.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Figure 1:
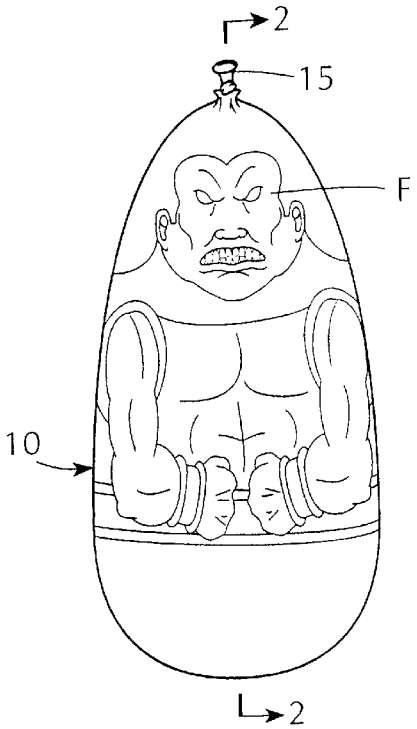
FIG. 1 is a perspective view of a pneumatic bop bag in accordance with the invention.
Figure 2:
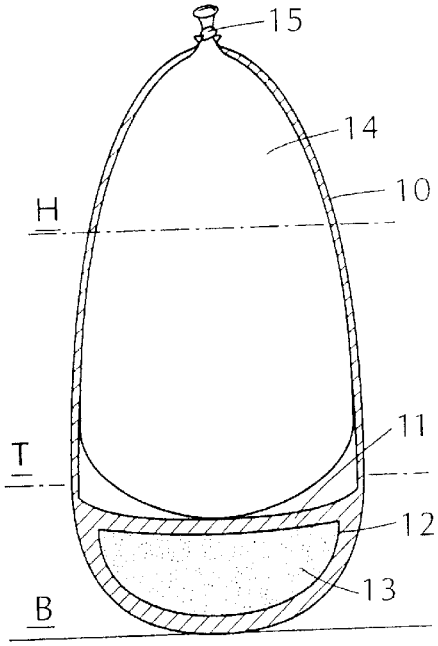
FIG. 2 is a section taken through the bag.

Referring now to FIGS. 1 and 2 a pneumatic bop bag in accordance with the invention includes a collapsible bag 10 fabricated of a high-strength, non-stretchable fabric, such as a woven fabric formed of cotton, canvas or synthetic plastic fibers, such as nylon or polyester. The fabric bag is shaped and graphically decorated to resemble an erect humanoid figure whose face F is somewhat gruesome, for the figure is intended to symbolize an individual who is hateful to the player and deserves to be beaten up.

The fabric bag which may be composed of contoured segments that are sewn together, includes a dome-shaped head zone H, an intermediate torso zone T having a frusto-conical shape, and a base zone B whose rounded bottom engages the horizontal ground or floor surface on which the bag rests when put to use.

Base zone B is provided with a fabric partition 11 which separates this zone from torso zone T and defines a compartment within which is confined a weighted convex dish 12. This enclosed dish which can be molded of synthetic plastic material or of aluminum, is fully filled with a heavy material, such as sand 13.

Disposed within torso zone T and head zone H thereabove is a balloon 14 having a stem 15 which projects through a slit is the top of head zone H so that the balloon can be mouth inflated. When the balloon is inflated, it then stretches and expands so that its rubber skin engages and conforms to the inner fabric surfaces of the torso and head zones, and the adjoining surface of fabric partition 11 stem 15 is then tied to seal the inflated balloon.

When an unconfined balloon is inflated, it then assumes a globular shape. But the balloon is easily burst, for if one strongly presses the inflated balloon, its skin will be stretched beyond its bursting point. But when balloon 14 confined with a non-stretchable fabric casing is inflated, its expanded rubber skin then engages and conforms to the inner surfaces of the fabric casing confining the balloon.

Hence the inflated balloon will assume not a globular form, but the contours of the fabric casing. The balloon, though fragile when unconfined, cannot be burst, for to be burst, it must be free to stretch beyond its bursting point. It cannot do so, for it is confined within the casing, and when inflated it is stretched therein below its bursting point. Obviously the size of the balloon to be used depends on the dimensions of the casing, and for a large casing a large balloon is required that will not burst when inflated within this casing.

On the other hand, a balloon-inflated bag has a high internal pressure, for in blowing up the balloon by mouth, an internal pressure must be developed sufficient to stretch the balloon to cause it to expand much beyond its deflated size to conform to the inner surfaces of the fabric bag. In blowing up a conventional plastic bop bag which is not stretchable, it takes a relatively low pressure to do so, for it is only necessary to fill the plastic bop bag with air to cause it to assume its inflated shape, but without the need to apply sufficient air pressure to stretch the bag. Hence a fabric bop bag having an inflated balloon therein has far better bounce characteristics than an inflated plastic bop bag, and it reacts more dramatically even to a weak punch.

Figure 3:
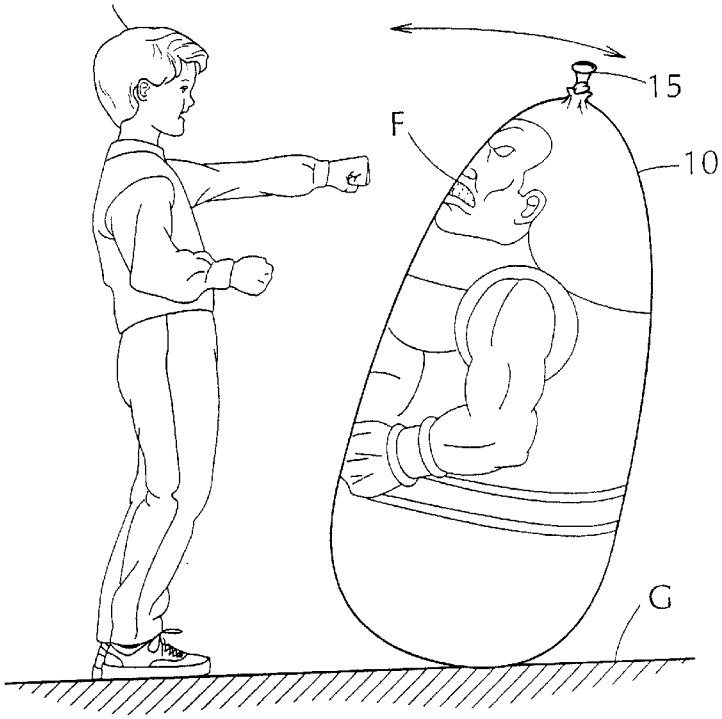
FIG. 3 shows a player punching the bop bag.
Figure 4:
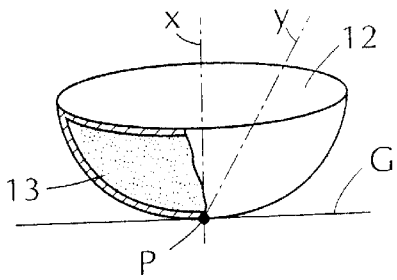
FIG. 4 is a separate view of the weighted convex dish included in the bag.

The weighted convex dish 12, as shown in FIG. 3, has a center pole P on its convex hemispherical which is normally aligned with a vertical axis X; hence when the bag is erect it is only pole P which makes point contact with the ground surface G. The center of gravity of the convex dish is at its center pole, for the resultant gravitational attraction acts through this fixed point. When therefore the bag is punched by a player, as shown in FIG. 3, and caused to swing to a degree that depends on the force of the punch, then dish 12 is caused to tilt so that pole P is now aligned with a tilt axis Y.

The gravitational force acting on the tilted dish will cause it to swing back and return, to its erect position in alignment with vertical axis X.

Because the balloon-inflated fabric casing is relatively light compared to an inflated plastic bop bag, even when the bag is severely tilted so that it tilts to a position not too far from to the ground, the bag will not then fall to the ground, for the weighted dish in the bag of the bag will swing the bag back to its erect position.

While there has been shown and described a preferred embodiment of a pneumatic bop bag in accordance with the invention, it will be appreciated that many changes and modifications may be made therein without, however, departing from the essential spirit thereof.

I claim:

1. A pneumatic bop bag comprising:

A. a collapsible casing formed of non-stretchable fabric material which when the casing is inflated then assumes an erect humanoid form in alignment with a vertical axis, said casing having an upper head zone provided with a slit, an intermediate torso zone and a lower base zone that rests on a horizontal ground surface;

B. a weighted convex dish confined within said base zone, said dish having a center pole that normally engages the ground surface and is aligned with said vertical axis; and C. a rubber balloon inflated within the head zone and the torso zone of bag to conform thereto to cause the bag to assume a three-dimensional erect humanoid form, the balloon having a stem which when the balloon is being inflated projects through said slit, whereby when a player punches the head zone, the bag then swings away from the vertical axis to an extent that depends on the force of the punch, and the bag as a result of a gravitational force imposed on the dish then swings back to its erect position.

2. A bop bag as set forth in claim 1, having a face printed on said head zone.

3. A bop bag as set forth in claim 1, in which the casing is formed by contoured fabric sections that are seamed together.

4. A bop bag as set forth in claim 1, in which the bag includes a fabric partition which separates the base zone from the torso zone and creates a compartment in which the dish is confined.

5. A bag as set forth in claim 1, in which the dish is molded of synthetic plastic material to create an enclosure filled with heavy material.

6. A bag as set forth in claim 5, in which the heavy material is sand.

7. A bag as set forth in claim 1, in which the woven fabric is made of nylon.

* * * * *